US011485152B2

(12) United States Patent
Takahashi

(10) Patent No.: US 11,485,152 B2
(45) Date of Patent: Nov. 1, 2022

(54) PRINTING DEVICE INCLUDING DISCHARGE TRAY POSITIONED DOWNSTREAM OF AND BELOW CUTTER UNIT

(71) Applicant: BROTHER KOGYO KABUSHIKI KAISHA, Nagoya (JP)

(72) Inventor: Hiroaki Takahashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/216,778

(22) Filed: Mar. 30, 2021

(65) Prior Publication Data

US 2021/0300081 A1 Sep. 30, 2021

(30) Foreign Application Priority Data

Mar. 30, 2020 (JP) ..... JP2020-061159

(51) Int. Cl.
*B41J 11/66* (2006.01)
*B41J 13/10* (2006.01)

(52) U.S. Cl.
CPC ..... *B41J 11/663* (2013.01)

(58) Field of Classification Search
CPC . B41J 11/66; B41J 11/663; B41J 11/70; B41J 13/0009; B41J 13/0036
See application file for complete search history.

(56) References Cited

U.S. PATENT DOCUMENTS

2013/0195536 A1* 8/2013 Yoshinuma ..... B26D 5/02 83/563

FOREIGN PATENT DOCUMENTS

| | | | |
|---|---|---|---|
| JP | S60-195854 U | | 12/1985 |
| JP | 2011-51114 A | | 3/2011 |
| JP | 2011-051114 A | | 3/2011 |
| JP | 2011051114 A | * | 3/2011 |
| JP | 2012-101926 A | | 5/2012 |

OTHER PUBLICATIONS

Akatsu, MachineTranslationofJP-2011051114-A, 2011 (Year: 2011).*
International Search Report and Written Opinion dated Jun. 8, 2021 from related PCT/JP2021/013631.

* cited by examiner

*Primary Examiner* — Scott A Richmond
(74) *Attorney, Agent, or Firm* — Scully, Scott, Murphy & Presser, PC

(57) ABSTRACT

A printing device includes: a pair of conveyer rollers for nipping a printing medium at a nipping position and conveying the printing medium in a conveying direction; a cutter unit positioned downstream of the conveyer rollers; a discharge tray positioned downstream of and below the cutter unit; and a controller. The controller is configured to perform: (a) cutting the printing medium by the cutter unit into first and second printing mediums; and (b) discharging the second conveying medium on top of the first printing medium on the discharge tray. The discharge tray is positioned to satisfy a formula of $H1>4\times10^{-7}\times D1^4$, where H1 represents a distance in a gravitational direction between the nipping position and a mounting surface of the discharge tray; and D1 represents a distance in the conveying direction between the nipping position and a downstream end of the cutter unit.

7 Claims, 6 Drawing Sheets

PRINTING DEVICE INCLUDING DISCHARGE TRAY POSITIONED DOWNSTREAM OF AND BELOW CUTTER UNIT

CROSS REFERENCE TO RELATED APPLICATION

This application claims priority from Japanese Patent Application No. 2020-061159 filed Mar. 30, 2020. The entire content of the priority application is incorporated herein by reference.

TECHNICAL FIELD

The present disclosure relates to a printing device.

BACKGROUND

Japanese Patent Application Publication No. 2011-051114 discloses a cutter device for cutting a rolled sheet. The cutter device is positioned at a downstream side of a discharge portion configured to discharge the rolled sheet subjected to an image recording process, and the cutter device is configured to cut the rolled sheet that is supported in a cantilevered manner by a roller for conveying the rolled sheet. The cutter device includes a cutter holder holding a pair of upper and lower rotary blades for cutting the rolled sheet. The cutter holder is reciprocally movable in a widthwise direction perpendicular to a discharging direction of the rolled sheet.

SUMMARY

As the above-described cutter device is configured to cut the rolled sheet, this cutter device does not assume cutting a sheet having a fixed sheet size. In the above-described cutter device, a portion of the rolled sheet downstream of a cut edge is dropped down by its own weight onto a discharge tray.

In contrast, when cutting a sheet having a fixed sheet size, a portion of the sheet downstream of a cut edge thereof is dropped down by its own weight onto a discharge tray upon completion of the cutting, whereas a remaining portion of the sheet upstream of the cut edge is dropped down onto the discharge tray after the remaining portion of the sheet reaches the discharge tray. In such a case, conceivably, the preceding portion and the subsequent portion of the sheet may be out of alignment with each other. It is therefore an object of the embodiment of the present disclosure to provide a cutter device that can provide an improved alignment or overlapping property between cut-off portions of printing medium.

In order to attain the above and other objects, according to one aspect, the disclosure provides a printing device including a pair of conveyer rollers, a cutter unit, a discharge tray, and a controller. The pair of conveyer rollers is configured to nip a printing medium at a nipping position and convey the printing medium in a conveying direction. The cutter unit is positioned downstream of the pair of conveyer rollers in the conveying direction and is configured to cut the printing medium conveyed by the pair of conveyer rollers. The cutter unit has a most downstream end in the conveying direction. The discharge tray is positioned downstream of the cutter unit in the conveying direction and below the cutter unit. The discharge tray includes a mounting surface. The controller is configured to perform: (a) cutting the printing medium into a first printing medium and a second printing medium by the cutter unit, and discharging the first printing medium divided from the printing medium onto the mounting surface of the discharge tray; and (b) conveying the second printing medium by the pair of conveyer rollers, and discharging the second conveying medium on top of the first printing medium discharged on the discharge tray. The discharge tray is positioned to satisfy a formula of $H1>4\times10^{-7}\times D1^4$, in which: H1 represents a distance in a gravitational direction between the nipping position and the mounting surface of the discharge tray; and D1 represents a distance in the conveying direction between the nipping position and the most downstream end in the conveying direction of the cutter unit.

According to another aspect, the disclosure also provides a printing device including a pair of conveyer rollers, a cutter unit, a discharge tray, and a controller. The pair of conveyer rollers is configured to nip a printing medium at a nipping position and convey the printing medium in a conveying direction. The cutter unit is positioned downstream of the pair of conveyer rollers in the conveying direction and is configured to cut the printing medium conveyed by the pair of conveyer rollers. The cutter unit has a most downstream end in the conveying direction. The discharge tray is positioned downstream of the cutter unit in the conveying direction and below the cutter unit. The discharge tray includes a mounting surface. The controller is configured to perform: (a) cutting the printing medium into a first printing medium and a second printing medium by the cutter unit, and discharging the first printing medium divided from the printing medium onto the mounting surface of the discharge tray; and (b) conveying the second printing medium by the pair of conveyer rollers, and discharging the second conveying medium on top of the first printing medium discharged on the discharge tray. The discharge tray is at such a position that a distance in a gravitational direction between the nipping position and the mounting surface of the discharge tray is greater than a deflection amount of the second printing medium by which the second printing medium nipped the pair of conveyer rollers flexes from the pair of conveyer rollers in the gravitational direction.

Still further, according to still another aspect, the disclosure also provides a printing device including a pair of conveyer rollers, a cutter unit, and a discharge tray. The pair of conveyer rollers is configured to nip a printing medium at a nipping position and convey the printing medium in a conveying direction. The cutter unit is positioned downstream of the pair of conveyer rollers in the conveying direction and is configured to cut the printing medium conveyed by the pair of conveyer rollers into a first printing medium and a second printing medium. The discharge tray is positioned below the cutter unit and downstream of the cutter unit in the conveying direction. The discharge tray includes a mounting surface. The second printing medium is configured to be discharged on the mounting surface after the first printing medium is discharged on the mounting surface. A trailing end of the first printing medium discharged on the mounting surface is positioned at a first location on the mounting surface. and a leading end of the second printing medium to be discharged on the mounting surface is configured to make contact with the mounting surface via the first printing medium at a second location, the second location being downstream of the first location in the conveying direction.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Hereinafter, a printing device 1 according to one embodiment of the present disclosure will be described invention while referring to FIGS. 1 through 4D.

<Structure of Printing Device 10>

Figure 1:
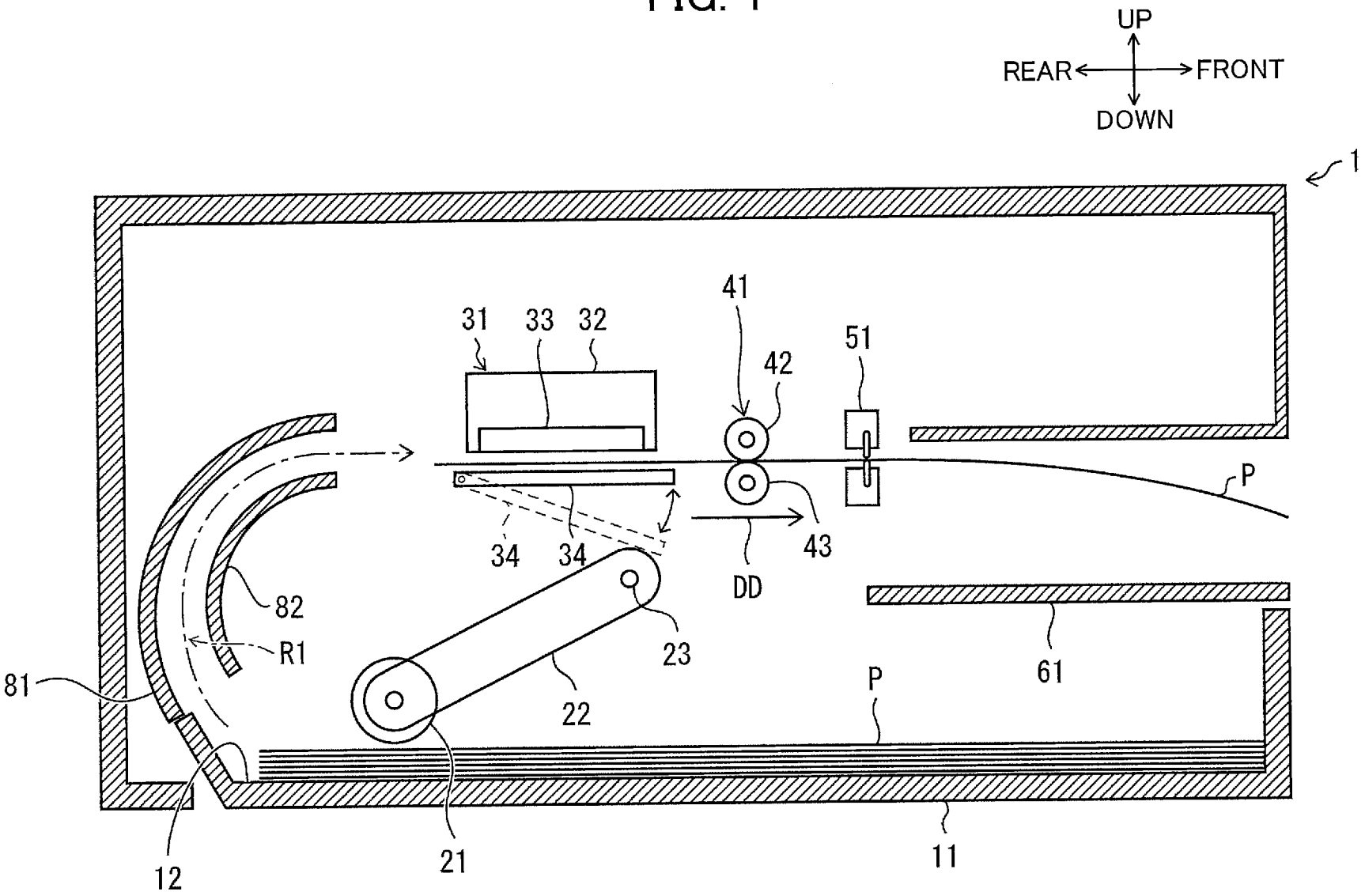
FIG. 1 is a cross-sectional view illustrating an internal structure of a printing device 1 according to one embodiment.

FIG. 1 is a cross-sectional view illustrating an internal structure of the printing device 1. The printing device 1 is an MFP (multi-function peripheral) provided with a printing function and a scanning function. The printing device 1 is configured to perform, for example, an inkjet type printing in which printing data designated by a print job is recorded on a sheet P (as an example of a printing medium) by ejecting ink on the sheet.

Incidentally, not only the inkjet type but also an electrophotographic type printing method is available as the printing method. Further, the printing device 1 may be a color printer or a monochromatic printer with respect to the sheet P. For convenience of the description, an upward/downward direction and a frontward/rearward direction with respect to the printing device 1 will be defined as indicated by arrows in FIG. 1. Further, the far side and the near side in FIG. 1 will defined as a rightward direction and a leftward direction with respect to the printing device 1, respectively.

As illustrated in FIG. 1, the printing device 1 includes a sheet supply tray 11, a sheet feed roller 21, a sheet feed arm 22, a sheet passage R1, an image recording unit 31, a pair of conveyer rollers 41, a cutter unit 51, and a discharge tray 61. The sheet supply tray 11 is a case for accommodating the sheets P, and has an upper open end. The sheet supply tray 11 includes a mount portion 12. The sheet supply tray 11 accommodates the sheets P mounted on the mount portion 12.

The sheet P has the A4 size, for example. However, the A3 size or B4 size is also available for the sheets P. In the following description, the sheet P is assumed to have the A4 size. As such, the A4 size is set as a size of the sheet P for the sheet supply tray 11. The sheet supply tray 11 and the discharge tray 61 are movable in the frontward/rearward direction with respect to an opening formed at a front portion of the printing device 1. Incidentally, not only a paper medium but also a resin medium such as an OHP sheet is available as the sheet P.

The sheet feed roller 21 is configured to supply the sheet P accommodated in the sheet supply tray 11 to the sheet passage R1. The sheet feed roller 21 is rotatably supported by a tip end portion of the sheet feed arm 22. The sheet feed arm 22 is pivotally movably supported by a shaft 23 supported by a frame (not illustrated) of the printing device 1. The sheet feed arm 22 is pivotally urged toward the sheet supply tray 11 by the self-weight of the sheet feed arm 22 or by a resilient force of a spring.

Figure 2:
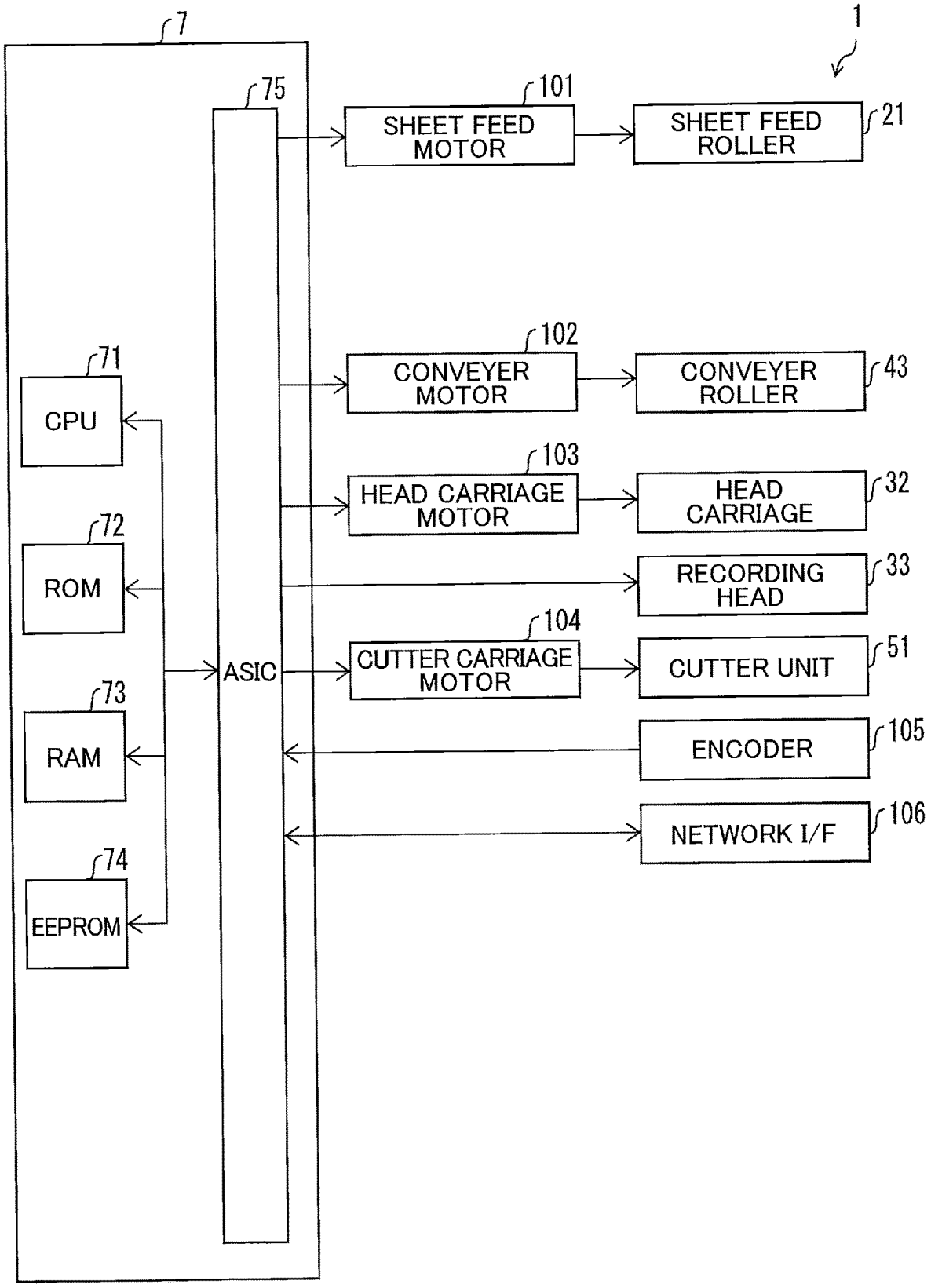
FIG. 2 is a block diagram illustrating an electrical configuration in the printing device 1 according to the embodiment.

The sheet feed roller 21 is configured to rotate in a forward direction in response to driving of a sheet feed motor 101 illustrated in FIG. 2. Each sheet P accommodated in the sheet supply tray 11 is delivered to the sheet passage R1 by the forward rotation of the sheet feed roller 21. The sheet P fed to the sheet passage R1 moves past a portion between curved members 81 and 82, and then is conveyed in a conveying direction DD through a portion between a head carriage 32 and a platen 34 those described later. The conveying direction DD is a frontward direction directed toward the front from the rear in the printing device 1.

The sheet passage R1 is a path extending upward from a rear end of the sheet supply tray 11 toward the discharge tray 61. Specifically, the sheet passage R1 extends upward from the rear end of the sheet supply tray 11, curving in a region between the curved members 81 and 82, and then extends linearly frontward through a portion between the head carriage 32 and the platen 34, and reaches the discharge tray 61.

The image recording unit 31 is positioned between the curved members 81, 82 and the pair of conveyer rollers 41 in the sheet passage R1, and is configured to record an image on the sheet P. The image recording unit 31 includes the head carriage 32, a recording head 33, and the platen 34. The recording head 33 is mounted on the head carriage 32.

The recording head 33 has a lower surface formed with a plurality of nozzles (not illustrated). In the recording head 33, ink droplets are ejected from the nozzles by oscillating oscillation elements such as piezoelectric elements. The platen 34 is a rectangular plate shaped member configured to mount thereon the sheet P. The recording head 33 selectively ejects ink droplets to record an image on the sheet P while the head carriage 32 moves relative to the sheet P supported on the platen 34.

The platen 34 is pivotally movable between a first position where the platen 34 extends in parallel to the conveying direction DD (indicated by a solid line in FIG. 1) and a second position where the platen 34 is pivotally moved downward by a predetermined angle from the first position (indicated by a broken line in FIG. 1). The platen 34 is at the first position for conveyance of the sheet P and during a printing operation. On the other hand, the platen 34 can be moved to the second position by a user to remove a jammed sheet P when a sheet jamming occurs.

The head carriage 32 is reciprocally movable in the leftward/rightward direction of the printing device 1, i.e., in the scanning direction, upon receipt of a driving force of a head carriage motor 103 illustrated in FIG. 2. In the image recording process on the sheet P, a controller 7 illustrated in FIG. 2 permits the recording head 33 to eject ink while permitting the head carriage 32 to move in the scanning direction in a state where conveyance of the sheet P is halted, thereby recording one-line worth of an image on the sheet P.

The pair of conveyer rollers 41 is positioned downstream of the image recording unit 31 in the conveying direction DD. The pair of conveyer rollers 41 includes conveyer rollers 42 and 43. The pair of conveyer rollers 41 is configured to nip the sheet P therebetween and convey the sheet P in the conveying direction DD. Specifically, the conveyer roller 42 is positioned above the sheet passage R1, and the conveyer roller 43 is positioned below the sheet passage R1 to face the conveyer roller 43.

The conveyer roller 43 is driven by a conveyer motor 102 illustrated in FIG. 2. The conveyer roller 42 is rotated by the rotation of the conveyer roller 43. The sheet P is nipped and conveyed in the conveying direction DD by the conveyer rollers 42 and 43. The conveyer roller 43 is provided with an encoder 105 configured to detect the rotation of the conveyer roller 43. The encoder 105 is configured to output pulse signals to the controller 7 in accordance with the rotation of the conveyer roller 43.

Incidentally, the conveyer roller 42 may be driven by the conveyer motor 102. In this case, the conveyer roller 43 is rotated by the rotation of the conveyer roller 42, the encoder 105 is provided at the conveyer roller 42, and the encoder 105 outputs pulse signals to the controller 7 in accordance with the rotation of the conveyer roller 42.

The cutter unit 51 is positioned downstream of the pair of conveyer rollers 41 in the conveying direction DD. The cutter unit 51 is configured to cut the sheet P conveyed by the pair of conveyer rollers 41. Details of the cutter unit 51 will be described later. The discharge tray 61 is positioned downstream of the cutter unit 51 in the conveying direction DD, and is positioned below the cutter unit 51. Further, the discharge tray 61 is positioned above the sheet supply tray 11.

<Electrical Configuration in Printing Device 1>

FIG. 2 is a block diagram illustrating an electrical configuration in the printing device 1. As illustrated in FIG. 2, the printing device 1 includes the controller 7, the sheet feed motor 101, the conveyer motor 102, the head carriage motor 103, a cutter carriage motor 104, the encoder 105, and a network interface 106.

The controller 7 includes a CPU (central processing unit) 71, a ROM (read-only memory) 72, a RAM (random-access memory) 73, an EEPROM (electronically erasable and programmable read-only memory, registered trademark) 74, and an ASIC (application-specific integrated circuit) 75 that are all interconnected via an internal bus.

The ROM 72 stores various programs such as for a program with which the CPU 71 executes various operations. The RAM 73 is used as a storage area for temporarily storing data and signals used when the CPU 71 executes the programs described above, or as a work area for data processing. The EEPROM 74 stores therein setting information that that must be preserved after the printing device 1 is turned off.

The controller 7 is configured to control the sheet feed motor 101, the conveyer motor 102, the head carriage motor 103, the recording head 33, and the cutter carriage motor 104 on a basis of a control program read out from the ROM 72. The ASIC 75 is connected to the sheet feed motor 101, the conveyer motor 102, the head carriage motor 103, the recording head 33, the cutter carriage motor 104, the encoder 105, and the network interface 106.

The ASIC 75 is configured to supply driving currents to the sheet feed motor 101, the conveyer motor 102, the head carriage motor 103, and the cutter carriage motor 104. The sheet feed motor 101, the conveyer motor 102, the head carriage motor 103, and the cutter carriage motor 104 are DC motors whose rotation speed becomes higher in response to an increase in supplied driving current and becomes lower in response to a decrease in supplied driving current.

The controller 7 is configured to control rotations of the sheet feed motor 101, the conveyer motor 102, the head carriage motor 103, and the cutter carriage motor 104 through, for example, PWM control (pulse width modulation control). Further, the controller 7 is configured to apply driving voltages to the oscillation elements of the recording head 33 for ejecting ink droplets through the nozzles. The controller 7 is also configured to detect a rotation amount of the conveyer roller 43 on a basis of the pulse signals outputted from the encoder 105. Further, the controller 7 is configured to estimate a conveying speed of the sheet P on a basis of the pulse signals outputted from the encoder 105.

The network interface 106 is connected to a network such as a LAN (local area network) so as to allow connection to an external device complied with a driver for the printing device 1. The printing device 1 is capable of receiving a print job containing identification information for identifying a kind of the sheet P through the network interface 106.

<Structure of Cutter Unit 51>

Figure 3A:
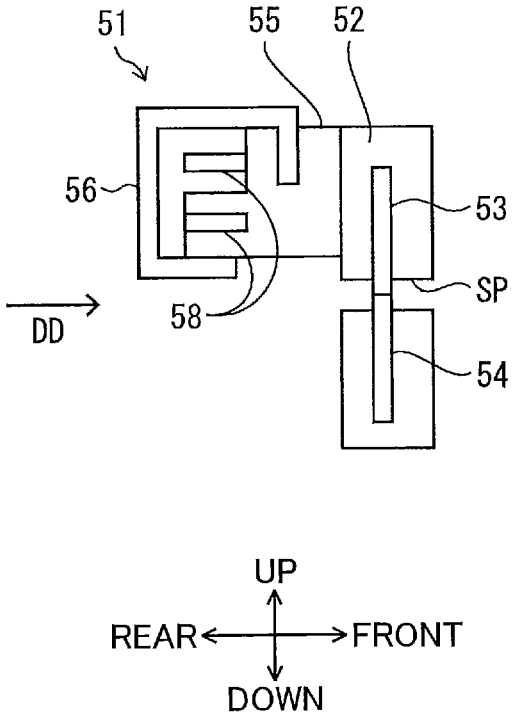
FIG. 3A is a vertical cross-sectional view of a cutter unit 51 provided in the printing device 1 according to the embodiment as viewed from a left side thereof.
Figure 3B:
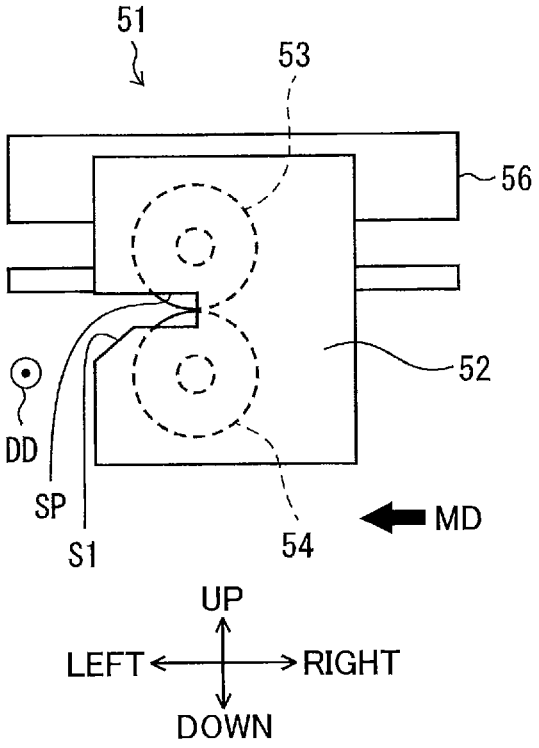
FIG. 3B is a front view of the cutter unit 51.
Figure 3C:
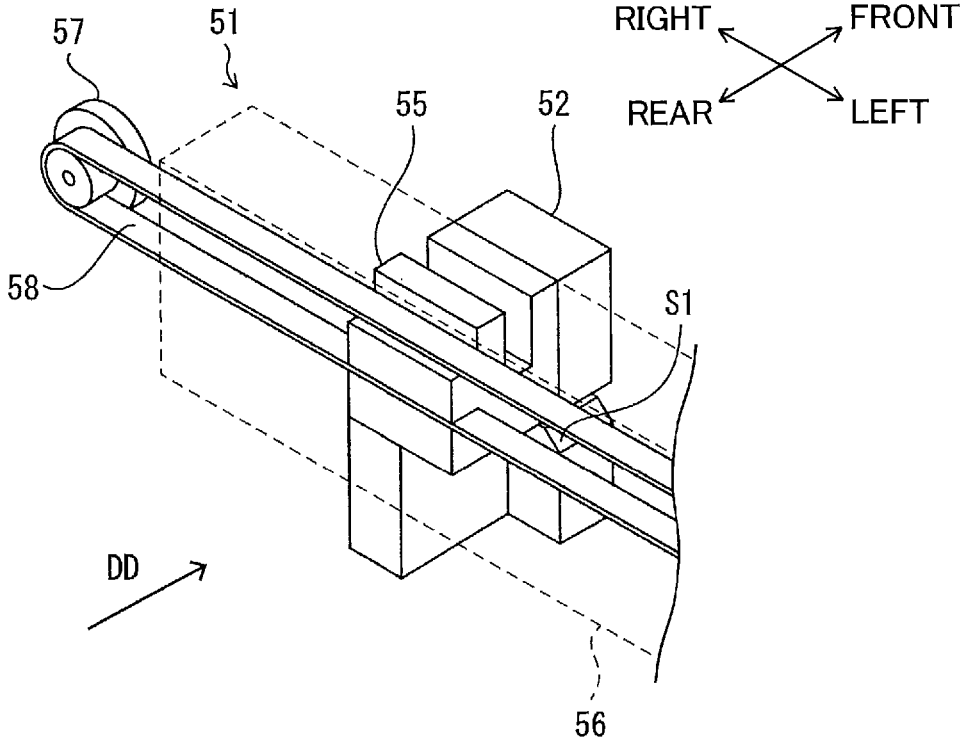
FIG. 3C is a partially-enlarged perspective view of the cutter unit 51.

FIGS. 3A to 3C are views illustrating a structure of the cutter unit 51 provided in the printing device 1 illustrated in FIG. 1. Specifically, FIG. 3A is a vertical cross-sectional view of the cutter unit 51 as viewed from a left side of the printing device 1. FIG. 3B is a front view of the cutter unit 51 as viewed from a front side of the printing device 1. FIG. 3C is a perspective view of the cutter unit 51.

As illustrated in FIGS. 3A through 3C, the cutter unit 51 includes a cutter carriage 52, blades 53 and 54, a fixing portion 55, a support rail 56, a rotation shaft 57, and an endless belt 58. The cutter unit 51 is configured to cut the sheet P on which an image is recorded by the image recording unit 31.

Specifically, the controller 7 controls the cutter unit 51 to cut the sheet P in a widthwise direction thereof by moving the cutter carriage 52 in the widthwise direction relative to the sheet P in a state where conveyance of the sheet P is halted with the sheet P nipped by the pair of conveyer rollers 41. The widthwise direction of the sheet P is perpendicular to the conveying direction DD. The cutter unit 51 is configured to cut the sheet P when the controller 7 determines cutting of the sheet P is necessary.

The cutter carriage 52 supports the blades 53 and 54 each having a disc shape. The cutter carriage 52 has a notch SP through which parts of the blades 53 and 54 are exposed to an outside. The cutter carriage 52 is fixed to the fixing portion 55 which is connected to the endless belt 58.

The support rail 56 extends in the widthwise direction of the sheet P. The support rail 56 supports the cutter carriage 52 so that the cutter carriage 52 is movable in the widthwise direction of the sheet P. The endless belt 58 is looped over the rotation shaft 57. The endless belt 58 is circularly moved in association with the rotation of the rotation shaft 57 in response to the rotation of the cutter carriage motor 104 illustrated in FIG. 2, so that the cutter carriage 52 is movable in the widthwise direction of the sheet P along the support rail 56.

As the sheet P enters into the notch SP in accordance with the movement of the cutter carriage 52 in the widthwise direction of the sheet P, the sheet P is cut by the blades 53 and 54. The cutter carriage 52 has a sloped surface S1 connected to the notch SP. The sloped surface S1 extends from a portion adjacent to cutting edges of the blades 53 and 54 toward a leading end of the cutter carriage 52 in a moving direction MD of the cutter carriage 52. That is, in the example of FIG. 3B, the sloped surface S1 slopes diagonally downward toward the left (downstream in the moving direction MD of the cutter carriage 52).

The sloped surface S1 is sloped diagonally downward toward the leading end of the cutter carriage 52 in the moving direction MD of the cutter carriage 52. The sloped surface S1 has a lower end that can be positioned below the sheet P that is deflected at the cutter carriage 52 while being nipped by the pair of conveyer rollers 41. The sheet P nipped by the pair of conveyer rollers 41 is guided to the cutting edges of the blades 53 and 54 along the sloped surface S1 because of the abutment of the sheet P with the sloped surface S1.

<Sheet Cutting>

Figure 4A:
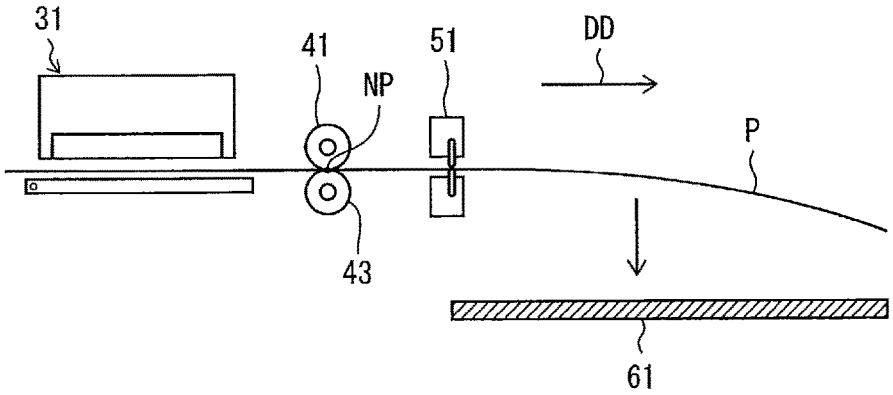
FIGS. 4A through 4D are views for description of cutting the sheet P by the cutter unit 51 provided in the printing device 1 according to the embodiment.
Figure 4B:
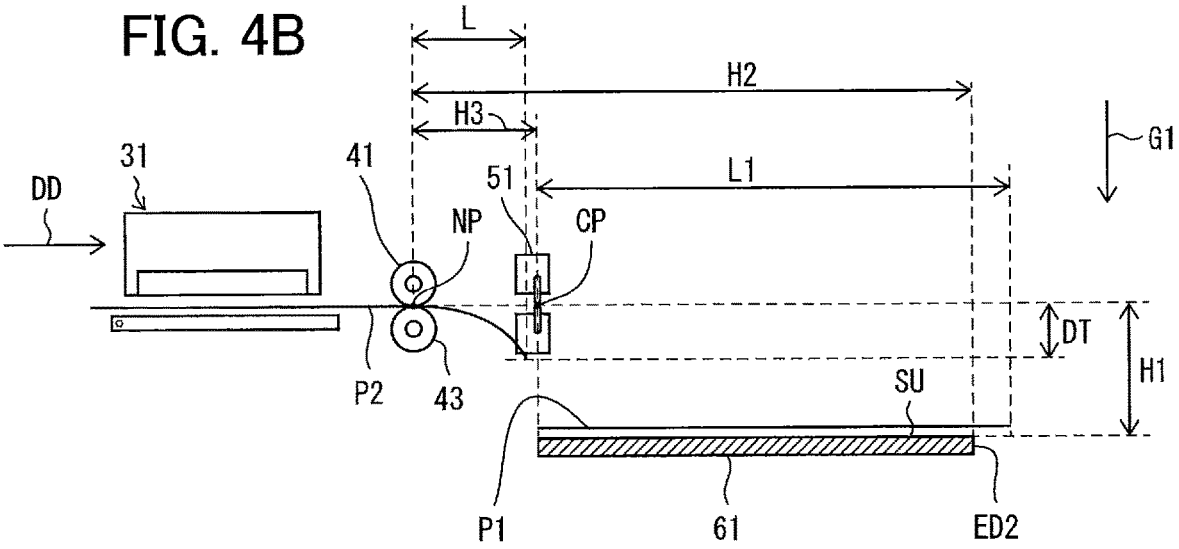
Figure 4C:
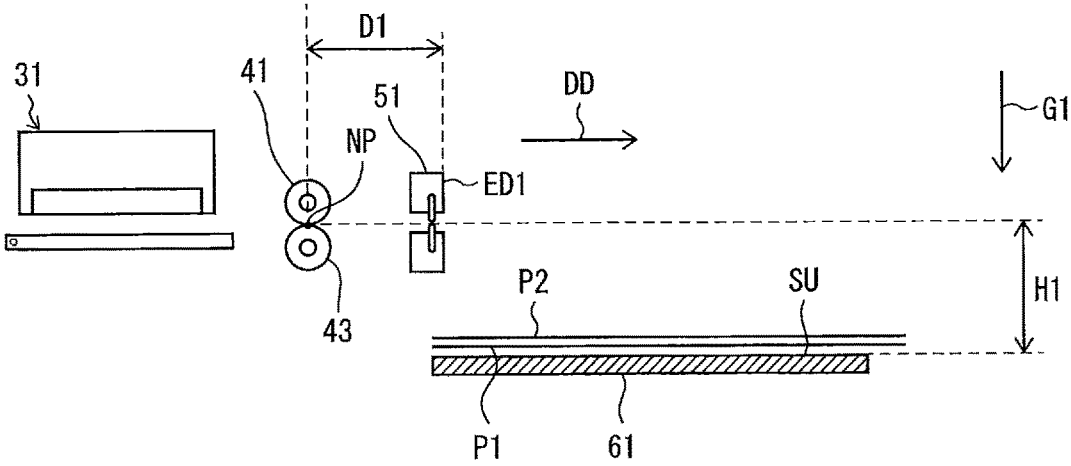

FIGS. 4A through 4C are views for description of cutting the sheet P by the cutter unit 51 provided in the printing device 1 illustrated in FIG. 1. Incidentally, in FIGS. 4A through 4C, delineation of components of the printing device 1 other than the image recording unit 31, the pair of conveyer rollers 41, the cutter unit 51, and the discharge tray 61 are omitted.

Here, as an example, assume a case where the controller 7 receives a print job from the external device through the network interface 106. In the print job, printing on an A4-sized sheet is assumed to be specified. In this case, the controller 7 drives the sheet feed motor 101 to rotate the sheet feed roller 21 so as to convey the A4 size sheet P accommodated in the sheet supply tray 11 to the sheet passage R1.

The controller 7 stops driving the sheet feed motor 101 when a leading edge of the sheet P reaches the pair of conveyer rollers 41 and a forward half portion (preceding half portion) of the sheet P reaches the image recording unit 31. The controller 7 then starts driving the recording head 33 and the head carriage motor 103 to record an image on the forward half portion of the sheet P. After completion of the image recording with respect to the forward half portion of the sheet P, the controller 7 starts driving the conveyer motor 102 to convey the sheet P in the conveying direction DD.

As illustrated in FIG. 4A, the controller 7 then stops rotating the conveyer motor 102 when a position of a center of the sheet P in the conveying direction DD becomes coincident with the position of the cutter unit 51. The controller 7 starts driving the recording head 33 and the head carriage motor 103 to record an image on a rear half portion of the sheet P. While the image recording is being performed with respect to the rear half portion of the sheet P, the controller 7 permits the cutter unit 51 to perform a cutting process for cutting the sheet P.

Specifically, as illustrated in FIG. 4B, the controller 7 performs the cutting process in which: the sheet P is cut by the cutter unit 51 and is divided into a first sheet P1 (forward half portion) and a second sheet P2 (rear half portion); and the first sheet P1 of the sheet P is discharged onto the discharge tray 61.

The sheet P is cut at its center by the cutter unit 51. Since the first sheet P1 and the second sheet P2 are two halves of the A4-sized sheet P, each of the first sheet P1 and the second sheet P2 has the A5 size. Incidentally, each of the first sheet P1 and the second sheet P2 has the A4 size in a case where the sheet P has the A3 size; and the first sheet P1 and the second sheet P2 respectively have the B5 size in a case where the sheet P has the B4 size.

The first sheet P1 cut and separated from the sheet P is dropped onto the discharge tray 61 because of own weight of the first sheet P1. As illustrated in FIG. 4C, after performing the above-described cutting process, the controller 7 performs a conveying process where the pair of conveyer rollers 41 conveys the second sheet P2 to discharge the second sheet P2 on top of the first sheet P1 that has already been discharged on the discharge tray 61.

Here, referring to FIG. 4C, H1 denotes a distance in a gravitational direction G1 between a nipping position NP where the conveyer rollers 41 nip the sheet P and a mounting surface SU of the discharge tray 61 on which the first sheet P1 is mounted. Further, D1 denotes a distance in the conveying direction DD between the nipping position NP and a downstream endmost portion ED1 of the cutter unit 51 in the conveying direction DD. In this case, the discharge tray 61 is set to be at such a position satisfying the following formula (1).

$$H1>4\times10^{-7}\times D1^4 \quad (1)$$

Provided that the discharge tray 61 is positioned to satisfy the above formula (1), the second sheet P2 can be prevented from being positioned below the first sheet P1 that has been discharged and mounted on the discharge tray 61 prior to discharge of the second sheet P2 onto the discharge tray 61. Hence, alignment quality of the second sheet P2 with respect to the first sheet P1 cut by the cutter unit 51 can be improved.

Figure 4D:
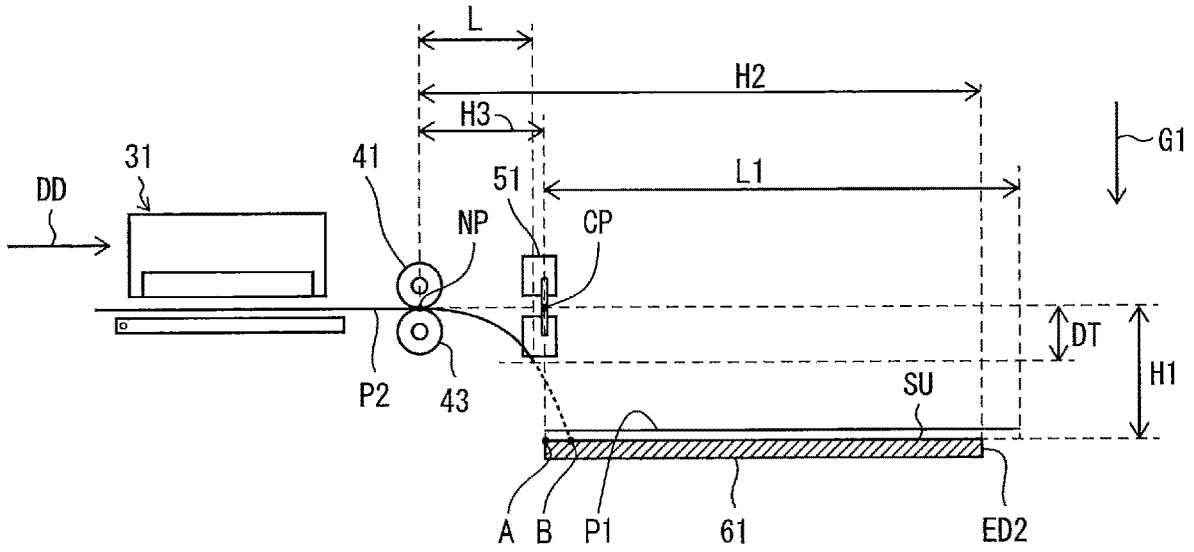

Specifically, referring to FIG. 4D, a first location A on the mounting surface SU represents a position where a trailing end (rear end) of the discharged first sheet P1 is positioned on the mounting surface SU. A second location B on the mounting surface SU represents a position where a leading end (front end) of the second sheet P2, which is subsequently to be discharged onto the mounting surface SU after the first sheet P1 is discharged on the mounting surface SU, is configured to make contact with the mounting surface SU via the first sheet P1. As illustrated in FIG. 4D, the second location B is positioned downstream of the first location A in the conveying direction DD. With the configuration of the embodiment, the second sheet P2 does not go below the first sheet P1, and is reliably placed on top of the first sheet P1 that has already been mounted on the mounting surface SU. Hence, alignment quality of the second sheet P2 with respect to the first sheet P1 cut by the cutter unit 51 can be improved.

Further, referring to FIG. 4B, the discharge tray 61 is so positioned that the distance H1 is greater than a deflection amount DT of the second sheet P2 in the present embodiment. Here, the deflection amount DT is a distance from the nipping position NP (where the pair of conveyer rollers 41 nips the second sheet P2) to a leading end of the second sheet P2 in the gravitational direction G1. That is, the deflection amount DT is an amount by which the leading end of the second sheet P2 flexes in the gravitational direction G1 from the nipping position NP. The deflection amount DT is represented by the following formula (2).

$$DT=WL^4/(8EI) \quad (2)$$

In the formula (2), W denotes uniformly distributed load applied to a deflected portion (flexed portion) of the second sheet P2 downstream of the pair of conveyer rollers 41. L denotes a length in the conveying direction DD of the deflected portion of the second sheet P2 downstream of the pair of conveyer rollers 41. E denotes Young's modulus of the second sheet P2. I denotes moment of inertia of area of the second sheet P2. The moment of inertia of area is represented by the following formula (3) in which B denotes a width of the second sheet P2 and T denotes a thickness of the second sheet P2.

$$I=BT^3/12 \quad (3)$$

As described above, the distance H1 in the gravitational direction G1 between the nipping position NP (where the pair of conveyer rollers 41 nips the sheet P) and the mounting surface SU of the discharge tray 61 (on which the first sheet P1 is mounted) is greater than the deflection amount DT of the second sheet P2 in the gravitational direction G1 Therefore, this configuration of the embodiment can avoid entry of the second sheet P2 into a portion below the first sheet P1 that has been discharged on the discharge tray 61 prior to the discharge of the second sheet P2. Accordingly, enhanced alignment quality of the second sheet P2 with respect to the first sheet P1 cut by the cutter unit 51 can be obtained.

Here, take a groundwood paper (trade name Oumu, a product of Daio Paper Corporation) as an example of the sheet P. This groundwood paper has the A4 size, a weight of 0.000104 N/mm, a length in the conveying direction DD of 297 mm, a width of 210 mm, and a thickness of 0.084 mm. The groundwood paper has a basis weight of 50.4 $g/m^2$, Clark stiffness of 62 $cm^3/100$, Young's modulus of 3117 MPa, and density of 0.0006 $g/mm^3$.

The moment of inertia of area I of the groundwood paper calculated on the basis of the above formula (3) is about 0.010372 $N/mm^4$ The deflection amount DT of the groundwood paper calculated on the basis of the above formula (2) is about $4\times10^{-7}\times L^4$. The distance H1 is preferably greater than the above deflection amount DT of the groundwood paper. Hence, preferably, the discharge tray 61 be so positioned to satisfy the above formula (1).

Further, in the conveying process, the controller 7 preferably permits the pair of conveyer rollers 41 to convey the second sheet P2 at a second conveying speed slower than a first conveying speed at which the controller 7 permits the pair of conveyer rollers 41 to convey the sheet P to the discharge tray 61 without performing the cutting process. In other words, in the conveying process under the control by the controller 7, the second sheet P2 is conveyed at a second rotation speed of the conveyer roller 43 lower than a first rotation speed of the conveyer roller 43 at which the sheet P is conveyed to the discharge tray 61 without the cutting process.

With this configuration, the second sheet P2 is conveyed at the second rotation speed of the conveyer roller 43 lower than the first rotation speed thereof at which the sheet P is conveyed to the discharge tray 61 without performing the cutting process. Therefore, the second sheet P2 can be discharged more slowly onto the discharge tray 61 than when the sheet P is not cut, and hence, improved alignment of the second sheet P2 with the first sheet P1 after being cut by the cutter unit 51 can be realized.

The controller 7 can control the rotation speed of the conveyer motor 102 for controlling the rotation speed of the conveyer roller 43. Therefore, the controller 7 can control not only the sheet P but also the conveying speed of the second sheet P2.

In FIG. 4B, H2 denotes a distance in the conveying direction DD between the nipping position NP and a most downstream end ED2 of the discharge tray 61 in the conveying direction DD. Further, H3 denotes a distance in the conveying direction DD between the nipping position NP and a cutting position CP at which the cutter unit 51 cuts the sheet P.

Further, L1 denotes a length in the conveying direction DD of the second sheet P2 in the cutting process. Since the second sheet P2 is a divided half portion of the sheet P set in the sheet supply tray 11, the first sheet P1 also has the length L1 in the conveying direction DD. As illustrated in FIG. 4B, the distance H2 is smaller than a total length (sum) of the distance H3 and the length L1. With this arrangement, the second sheet P2 is discharged on the discharge tray 61 such that a part (leading end) of the second sheet P2 protrudes out from the discharge tray 61. Therefore, a user can easily take out the second sheet P2 from the discharge tray 61.

Preferably, the controller 7 controls the rotation speed of the pair of conveyer rollers 41 so that the part of the second sheet P2 conveyed by the pair of conveyer rollers 41 protrudes further forward than the most downstream end ED2 of the discharge tray 61 in the conveying direction DD. In this case, the controller 7 controls the rotation speed of the conveyer motor 102 to control the rotation speed of the conveyer roller 43, thereby controlling the rotation speed of the pair of conveyer rollers 41.

<Modifications to the Embodiment>

Figure 5A:
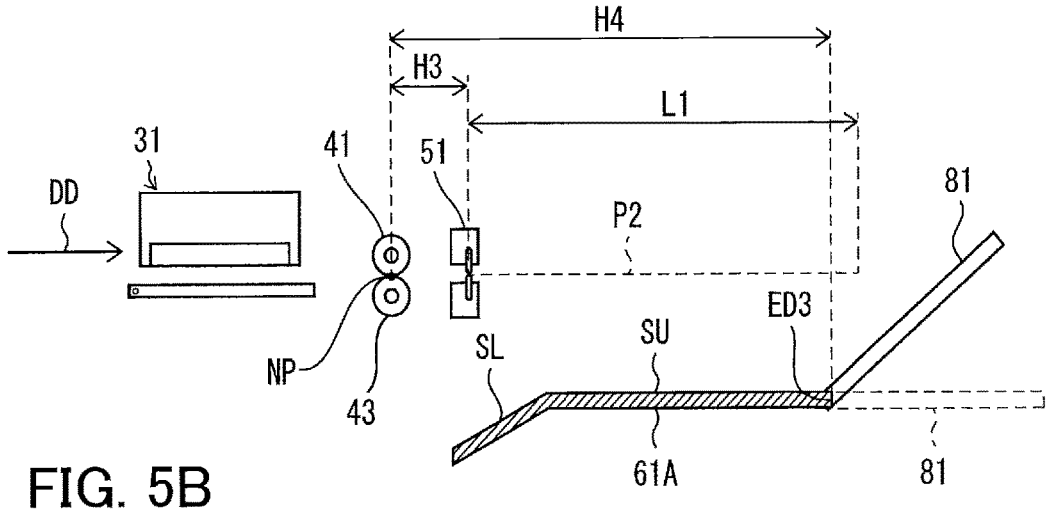
FIGS. 5A and 5B are schematic views of a discharge tray 61A according to a first modification to the embodiment.
Figure 5B:
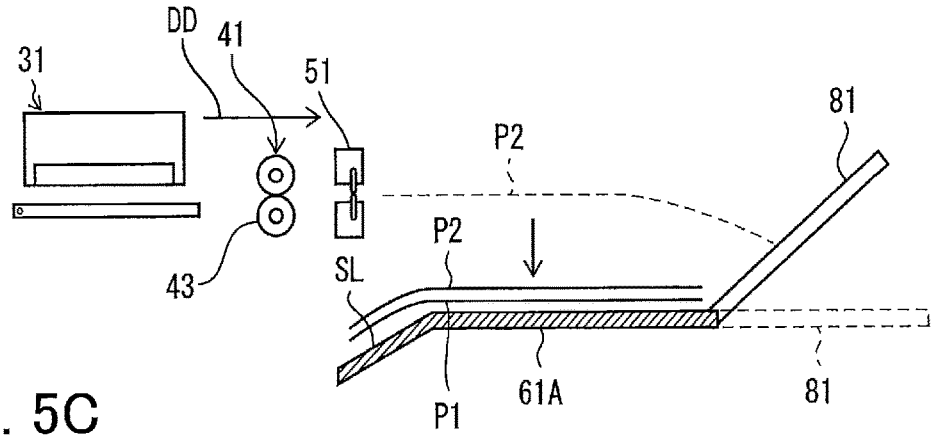
Figure 5C:
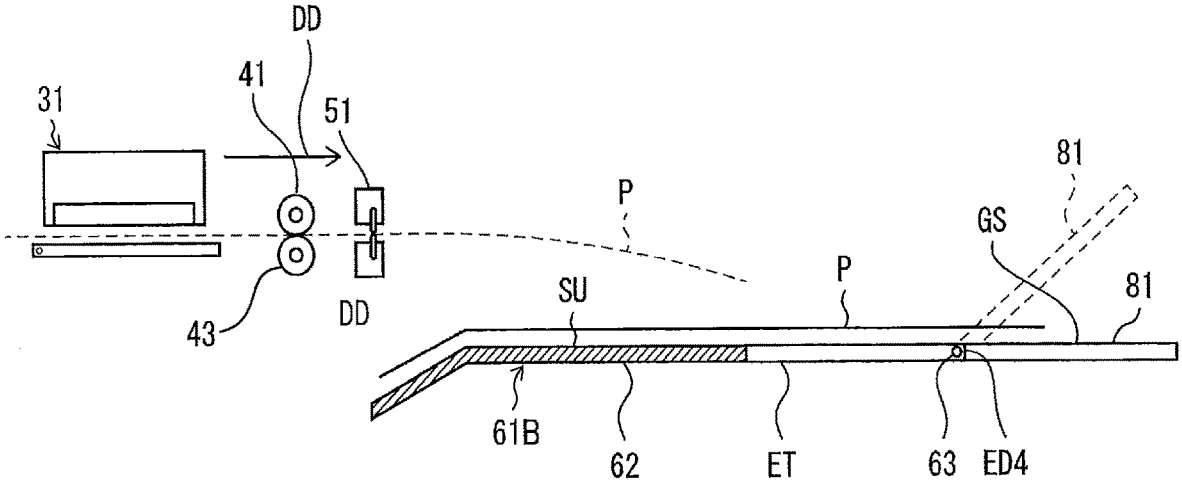
FIG. 5C is a schematic view of a discharge tray 61B according to a second modification to the embodiment.

FIGS. 5A through 5C illustrate various modifications to the discharge tray 61 of the printing device 1.

FIGS. 5A and 5B illustrate a first medication where a discharge tray 61A and a guide member 81 connected thereto are provided, in place of the discharge tray 61, in the printing device 1. Incidentally, components other than the image recording unit 31, the pair of conveyer rollers 41, the cutter unit 51, the discharge tray 61A, and the guide member 81 are omitted from FIGS. 5A through 5C.

As illustrated in FIG. 5A, the printing device 1 may include the guide member 81. The guide member 81 is connected to the discharge tray 61A, and is configured to guide a leading end portion of the second sheet P2 discharged on the discharge tray 61A. The guide member 81 is pivotally movably connected to a most downstream end portion of the discharge tray 61A in the conveying direction DD.

When the second sheet P2 is discharged onto the discharge tray 61A, the guide member 81 is preferably at a fixed position inclined diagonally upward relative to the mounting surface SU of the discharge tray 61A (as indicated by solid lines in FIGS. 5A and 5B) to permit the second sheet P2 to be abutted on the guide member 81.

In FIG. 5A, H4 denotes a distance in the conveying direction DD between the nipping position NP and one end portion ED3 of the guide member 81 in the conveying direction DD. The end portion ED3 of the guide member 81 is a most upstream end of the guide member 81 in the conveying direction DD and is connected to the most downstream end portion in the conveying direction DD of the discharge tray 61A. Here, the distance H4 is smaller than the total length (sum) of the distance H3 and the length L1. Incidentally, in FIG. 5A, the length L1 is indicated in a horizontally linear orientation of the second sheet P2 as a matter of convenience. Further, the distance H4 may be equal to the distance H2.

As illustrated in FIG. 5B, when the second sheet P2 is conveyed by the pair of conveyer rollers 41, the second sheet P2 is discharged onto the discharge tray 61A while the second sheet P2 is in abutment with the guide member 81. That is, the second sheet P2 is guided by the guide member 81. Hence, the alignment between the first sheet P1 and the second sheet P2 after the sheet P is cut by the cutter unit 51 can be improved.

Preferably, the controller 7 controls the rotation speed of the pair of conveyer rollers 41 so that the second sheet P2 conveyed by the pair of conveyer rollers 41 can abut on the guide member 81. In this case, the controller 7 can control the rotation speed of the pair of conveyer rollers 41 by controlling the rotation speed of the conveyer motor 102 to control the rotation speed of the conveyer roller 43.

The discharge tray 61A includes a sloped portion SL. The sloped portion SL is sloped to extend diagonally downward from the mounting surface SU while extending in a direction opposite to the conveying direction DD. With this structure, the entry of the second sheet P2 below the first sheet P1 can be prevented, since the trailing end portion in the conveying direction DD of the first sheet P1 is mounted on the sloped portion SL therealong.

FIG. 5C illustrates a second modification to the discharge tray 61 of the embodiment. As illustrated in FIG. 5C, a discharge tray 61B of the second modification includes: a tray body 62 having the mounting surface SU; and a retractable extension portion ET. The extension portion ET is extendable in the conveying direction DD from the tray body 62. The extension portion ET is retractable inside the tray body 62, and is extendable outward from the interior of the tray body 62.

The guide member 81 is pivotally movably connected to a most downstream end portion ED4 of the extension portion ET in the conveying direction DD. Specifically, the guide member 81 is pivotally movably supported by a shaft 63 supported by the extension portion ET. The guide member 81 may be pivotally movably connected to a most downstream end portion of the tray body 62 in the conveying direction DD (which corresponds to the most downstream end ED2 of the discharge tray 61 in the embodiment).

Further, preferably, in a case where the sheet P is discharged to the discharge tray 61B without being cut by the cutter unit 51, the position of the guide member 81 is fixed in such an orientation that the guide member 81 (a guide surface GS thereof) extends parallel to the mounting surface SU (as indicated by a solid line in FIG. 5C) for permitting the leading end portion of the sheet P to be supported by the guide member 81. Since the guide member 81 in parallel to the mounting surface SU is connected to the extension portion ET of the discharge tray 61B, the guide member 81 can guide the leading end portion of the sheet P to be discharged onto the discharge tray 61B.

Further, in a case where the sheet P is cut by the cutter unit 51 into the first sheet P1 and the second sheet P2 while the guide member 81 is set in parallel to the mounting surface SU, i.e., in a case where the controller 7 performs the cutting process while the guide member 81 is set in parallel to the mounting surface SU, preferably, the second conveying speed for conveying the second sheet P2 in the subsequent conveying process is set at such a conveying speed that the second sheet P2, when discharged, does not reach the guide surface GS of the guide member 81.

With this configuration, the discharge tray 61B can not only support the second sheet P2 and the first sheet P1, but also guide the sheet P without being cut together with the guide member 81. Further, when supporting the second sheet P2 and the first sheet P1 and guiding the uncut sheet P, the arrangement of the guide member 81 in parallel to the mounting surface SU can prevent the second sheet P2 from arriving at the guide surface GS of the guide member 81. Therefore, aligning or sheet overlapping property between the second sheet P2 and the first sheet P1 that have been cut by the cutter unit 51 can be improved.

In a case where the sheet P is discharged onto the discharge tray 61B without being cut by the cutter unit 51, the discharge tray 61B can support the sheet P (whose size is greater than the size of the first sheet P1 and the second sheet P2) by means of the tray body 62, the extension portion ET, and the guide member 81. Further, the extension portion ET is movable (retractable) in the conveying direction DD relative to the tray body 62. Hence, the position of the guide member 81 in the conveying direction DD can be made movable.

In the configuration of FIG. 5C, when the second sheet P2 cut by the cutter unit 51 is discharged onto the discharge tray 61B, the extension portion ET may be accommodated inside the tray body 62. With this structure, the second sheet P2 can be brought into contact with the guide member 81.

Further, when the sheet P is discharged onto the discharge tray 61B without being cut by the cutter unit 51, the extension portion ET may be pulled out of the tray body 62. With this structure, the uncut sheet P can be supported by the guide member 81, the extension portion ET, and the tray body 62.

In this case where the uncut sheet P is discharged onto the discharge tray 61B, the guide member 81 may be fixed in an inclined posture where the guide member 81 is inclined relative to the mounting surface SU of the discharge tray 61B (as indicated by a broken line in FIG. 5C). With this structure, the sheet P without being cut by the cutter unit 51 can reliably abut on the guide member 81, thereby improving alignment of the sheet P. Further preferably, in this case, the controller 7 may control the rotation speed of the pair of conveyer rollers 41 such that the sheet P conveyed by the pair of conveyer rollers 41 can abut on the guide member 81.

While the description has been made in detail with reference to the embodiments, it would be apparent to those skilled in the art that many modifications and variations may be made thereto.

[Remarks]

The printing device 1 is an example of a printing device. The sheet P is an example of a printing medium. The first sheet P1 is an example of a first printing medium, and the second sheet P2 is an example of a second printing medium. The pair of conveyer rollers 41 is an example of a conveyer rollers. The cutter unit 51 is an example of a cutter unit. The discharge trays 61, 61A and 61B are examples of a discharge tray. The controller 7 is an example of a controller. The nipping position NP is an example of a nipping position. The cutting position CP is an example of a cutting position. The conveying direction DD is an example of a conveying direction. The downstream endmost portion ED1 of the cutter unit 51 is an example of a most downstream end of the cutter unit. The guide member 81 is an example of a guide member. The most downstream end ED2 of the discharge tray 61 is an example of a most downstream end of the discharge tray.

What is claimed is:

1. A printing device comprising:

a pair of conveyer rollers configured to nip a printing medium at a nipping position and convey the printing medium in a conveying direction;

a cutter unit positioned downstream of the pair of conveyer rollers in the conveying direction and configured to cut the printing medium conveyed by the pair of conveyer rollers, the cutter unit having a most downstream end in the conveying direction;

a discharge tray positioned downstream of the cutter unit in the conveying direction and below the cutter unit, the discharge tray comprising a mounting surface; and a controller configured to perform:

(a) cutting the printing medium into a first printing medium and a second printing medium by the cutter unit, and discharging the first printing medium divided from the printing medium onto the mounting surface of the discharge tray; and (b) conveying the second printing medium by the pair of conveyer rollers, and discharging the second conveying medium on top of the first printing medium discharged on the discharge tray, the discharge tray being positioned to satisfy a formula of $H1>4\times10^{-7}\times D1^{4}$, in which:

H1 represents a distance in a gravitational direction between the nipping position and the mounting surface of the discharge tray; and D1 represents a distance in the conveying direction between the nipping position and the most downstream end in the conveying direction of the cutter unit.

2. The printing device according to claim 1, wherein the controller is further configured to perform (c) conveying, by the pair of conveying rollers, the printing medium in the conveying direction at a first conveying speed without cutting the printing medium, and discharging the printing medium onto the mounting surface of the discharge tray, wherein, in the (b) conveying, the controller is configured to control the pair of conveyer rollers to convey the second printing medium at a second conveying speed lower than the first conveying speed.

3. The printing device according to claim 2, further comprising a guide member connected to the discharge tray and configured to guide a leading end of the printing medium to be discharged onto the discharge tray, the guide member having a guide surface, wherein the second conveying speed in the (b) conveying is so set that a leading end of the second printing medium does not reach the guide surface.

4. The printing device according to claim 1, further comprising:

a sheet supply tray configured to accommodate therein the printing medium; and a guide member connected to the discharge tray and configured to guide a leading end of the second printing medium to be discharged onto the mounting surface of the discharge tray, the guide member having a most upstream end in the conveying direction, wherein the cutter unit is configured to cut the printing medium at a cutting position in the conveying direction, wherein a distance in the conveying direction between the nipping position and the most upstream end in the conveying direction of the guide member is smaller than a sum of: a distance in the conveying direction between the nipping position and the cutting position of the cutter unit; and a length in the conveying direction of the second printing medium divided out from the printing medium set in the sheet supply tray.

5. The printing device according to claim 1, further comprising a guide member connected to the discharge tray and configured to guide a leading end of the second printing medium to be discharged onto the mounting surface of the discharge tray, wherein the controller is configured to control a rotation speed of the pair of conveyer rollers such that the second printing medium conveyed by the pair of conveyer rollers abuts on the guide member.

6. The printing device according to claim 1, further comprising a sheet supply tray configured to accommodate therein the printing medium, wherein the discharge tray has a most downstream end in the conveying direction, wherein the cutter unit is configured to cut the printing medium at a cutting position in the conveying direction, wherein a distance in the conveying direction between the nipping position and the most downstream end in the conveying direction of the discharge tray is smaller than a sum of: a distance in the conveying direction between the nipping position and the cutting position of the cutter unit; and a length in the conveying direction of the second printing medium divided out from the printing medium set in the sheet supply tray.

7. The printing device according to claim 1, wherein the discharge tray has a most downstream end in the conveying direction, wherein, in the (b) conveying, the controller is configured to control a rotation speed of the pair of conveyer rollers such that a part of the second printing medium conveyed by the pair of conveyer rollers protrudes further in the conveying direction than the most downstream end in the conveying direction of the discharge tray.

* * * * *